United States Patent [19]

Rosenburg

[11] Patent Number: 4,549,690

[45] Date of Patent: Oct. 29, 1985

[54] COLLAPSIBLE BOTTOM STRUCTURE FOR EIGHT-SIDED CONTAINER

[75] Inventor: Charles W. Rosenburg, North Tonawanda, N.Y.

[73] Assignee: F. N. Burt Company, Inc., Buffalo, N.Y.

[21] Appl. No.: 634,633

[22] Filed: Jul. 26, 1984

[51] Int. Cl.[4] ..... B65D 5/36

[52] U.S. Cl. ..... 229/41 C; 229/38; 229/39 R

[58] Field of Search ..... 229/39 R, 41 C, 41 D, 229/23 R, 23 BT, 38, 41 R, 41 B

[56] References Cited

U.S. PATENT DOCUMENTS

| | | | |
|---|---|---|---|
| 2,011,232 | 8/1935 | Parks et al. | 229/41 B |
| 2,970,740 | 2/1961 | Fowle et al. | 229/38 |
| 3,010,887 | 3/1977 | Durham | 229/41 C |
| 3,101,167 | 8/1963 | Styler | 229/41 C |
| 3,809,310 | 5/1974 | Vanderlugt, Jr. | 229/41 C |
| 3,827,623 | 8/1974 | Arneson | 229/41 C |
| 3,907,194 | 9/1975 | Davenport et al. | 229/23 BT |
| 4,134,531 | 1/1979 | Martinez et al. | 229/23 BT |
| 4,146,169 | 3/1979 | Meyers et al. | 229/41 C |
| 4,199,098 | 4/1980 | Lopez | 229/41 C |
| 4,225,078 | 9/1980 | Croley | 229/41 C |
| 4,260,100 | 4/1981 | Hoffman | 229/39 R |
| 4,264,031 | 4/1981 | Goebel | 229/41 C |
| 4,289,267 | 9/1981 | Mayer | 229/39 R |

FOREIGN PATENT DOCUMENTS

| | | | |
|---|---|---|---|
| 222228 | 11/1957 | Australia | 229/39 R |
| 1124422 | 2/1962 | Fed. Rep. of Germany | 229/41 C |
| 2641791 | 3/1978 | Fed. Rep. of Germany | 229/41 C |
| 672791 | 10/1964 | Italy | 229/41 R |
| 967220 | 8/1964 | United Kingdom | 229/41 C |
| 2099401 | 12/1982 | United Kingdom | 229/38 |

*Primary Examiner*—William Price
*Assistant Examiner*—Gary E. Elkins
*Attorney, Agent, or Firm*—Christel, Bean & Linihan

[57] ABSTRACT

An eight-sided container (10) formed from a single blank which can be machine glued, partially manually erected, and fully opened by the insertion of its contents. The container includes eight side panels (12–26) a side glue flap (28), a large octagonal top (34) and a bottom formed of three pairs of flaps (54) being machine glued to an adjacent flap (56). The third pair of flaps (58) are substantially larger than the other pair of flaps and are adapted to overlie and interlock with each other to provide a strong bottom.

16 Claims, 6 Drawing Figures

COLLAPSIBLE BOTTOM STRUCTURE FOR EIGHT-SIDED CONTAINER

FIELD OF THE INVENTION

The present invention relates generally to a container, and more particularly to an eight-sided erectable paperboard container of the type which can be formed from a single blank of material, glued at the container making factory, shipped flat to another location where the container is to be filled, the container being partially opened manually at the filling location, and the opening of the container to its fully erected position being completed by the placing of the contents within the partially opened container.

BACKGROUND OF THE INVENTION

A variety of folded paperboard containers having eight sides are well known in the art. Typical examples are U.S. Pat. Nos. 4,199,098 and 4,289,267. Each of these prior art containers, as well as others, are formed from paperboard blanks that are divided by fold lines into a plurality of side panels as well as top and bottom forming flaps or panels. The folded paperboard type of container is widely accepted by industry because it may be provided with a varying number of sides, it is relatively inexpensive to produce, and takes little storage space in its folded condition. In addition, it readily accepts printing on its exterior surfaces.

One of the difficulties encountered in developing a container having a large number of sides is the construction of the bottom which will provide adequate support for the contents of the container, which contents may for example be a liquor bottle, and yet which can be easily erected. The so called "automatic bottom" has been developed which is formed of a number of bottom panels which are connected to each of the side panels of the container by fold lines. During construction, various bottom panels are glued, or otherwise bonded to each other, so that the combination of bonded and folded bottom panels interlock with each other to form the bottom of the container. The automatic bottom does not require any manipulative steps on the part of the user to form the bottom of the container, rather the bottom is automatically formed when the container is opened to its full form. U.S. Pat. No. 4,289,267 discloses one form of automatic bottom which may be suitable for an eight-sided container, however, this design has several drawbacks. Thus, by forming the bottom from a number of panels of generally the same size it is not possible to achieve the strength desired as when it is formed from bottom flaps, which include two large flaps which, when pushed into position, form a strong bottom because they interlock and overlap with each other.

OBJECTS AND SUMMARY OF THE INVENTION

It is an object of the present invention to provide an eight-sided container which may be formed of folded paperboard or the like, which container has improved characteristics over the known prior art.

More specifically, it is an object of the present invention to provide an eight-sided container which can be formed from a single blank, which blank can be machine glued after it has been die cut to the requisite shape, and which can then be shipped in a relatively flat condition to another location where the container is to be filled.

It is another object of the present invention to provide an eight-sided container of the type specified above which can be partially opened manually.

It is a further object of the present invention to provide an eight-sided container of the type specified above wherein the container can be opened to its full extent by the insertion of the contents within a partially opened container, the container having a glued bottom that will have sufficient strength to hold the contents which may, for example, be a heavy bottle.

The above objects and other objects and advantages of this invention are achieved by forming an octagonal carton from a single blank of novel design. The erected carton will have, in one preferred form, a top which is formed from a single panel having an octagonal configuration and three hinged tucks or tabs which are hingedly secured to spaced-apart edges of the top panel. These tucks or tabs are adapted to be received between four small spaced-apart top panels which are hingedly secured to top edges of alternate panels. The bottom includes two sets of three adjacent flaps. Each set is of the same configuration and includes first and second relatively small flaps and a third large flap. Glue is applied to the first flap of each set and then the second flap of each bottom set is secured to the adjacent first flap to partially assemble the container. The bottom flaps are so configured that the glued flaps and the large unglued flap of each set nest over one another completely around the bottom of the container when the container is fully erected, but which may lay in the plane of the container when it is folded. Although the large flaps of each set are not adhesively secured, they are forced into place as the container is opened during the final erection when it receives its contents, the large flaps forming protection across the bottom and interlocking and overlapping with each other.

The objects set forth above, as well as other objects and advantages of this invention, as well as the structure required to accomplish the desired objects, will become more apparent after a consideration of the following detailed description taken in conjunction with the accompanying drawings in which a preferred form of this invention is illustrated.

DETAILED DESCRIPTION

Figure 1:
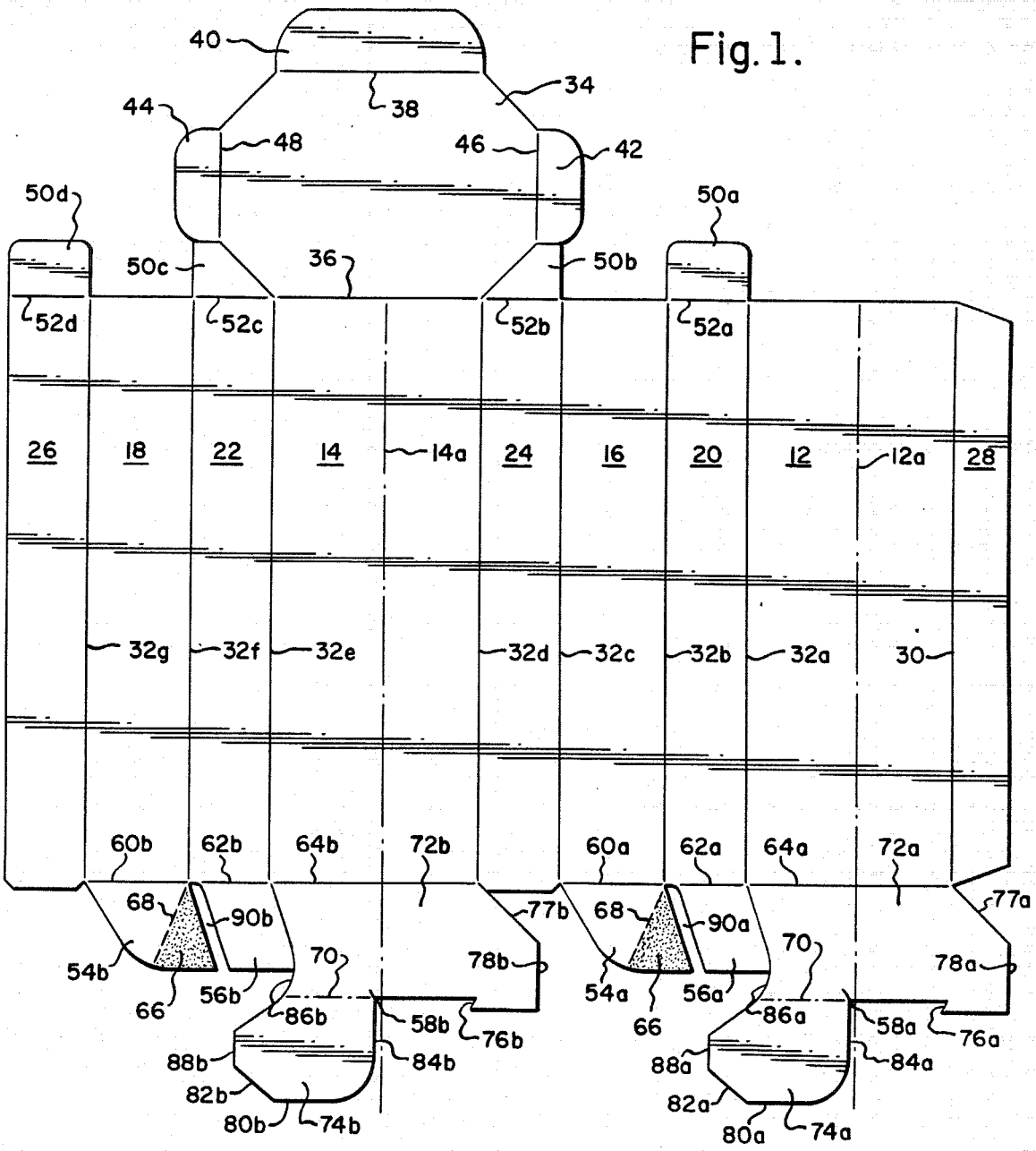
FIG. 1 is a view illustrating the design of the blank from which the eight-sided container of this invention is formed.
Figure 5:
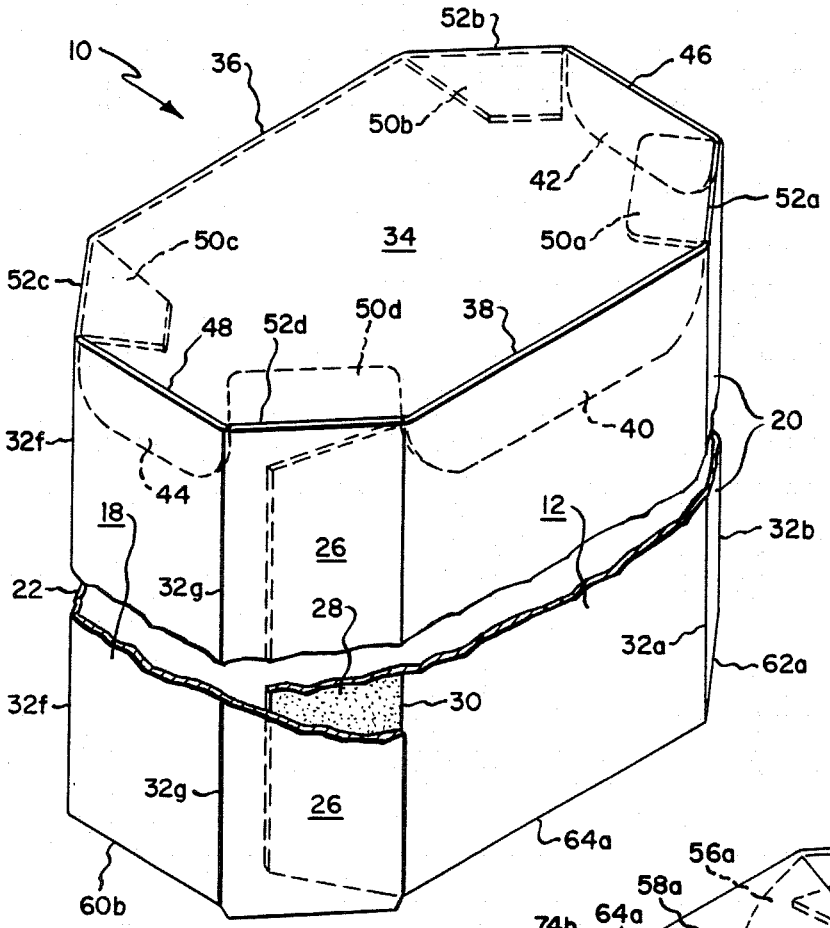
FIG. 5 is a perspective view of the fully erected container of this invention, this view being taken from the top left front, various portions having been eliminated for convenience.
Figure 6:
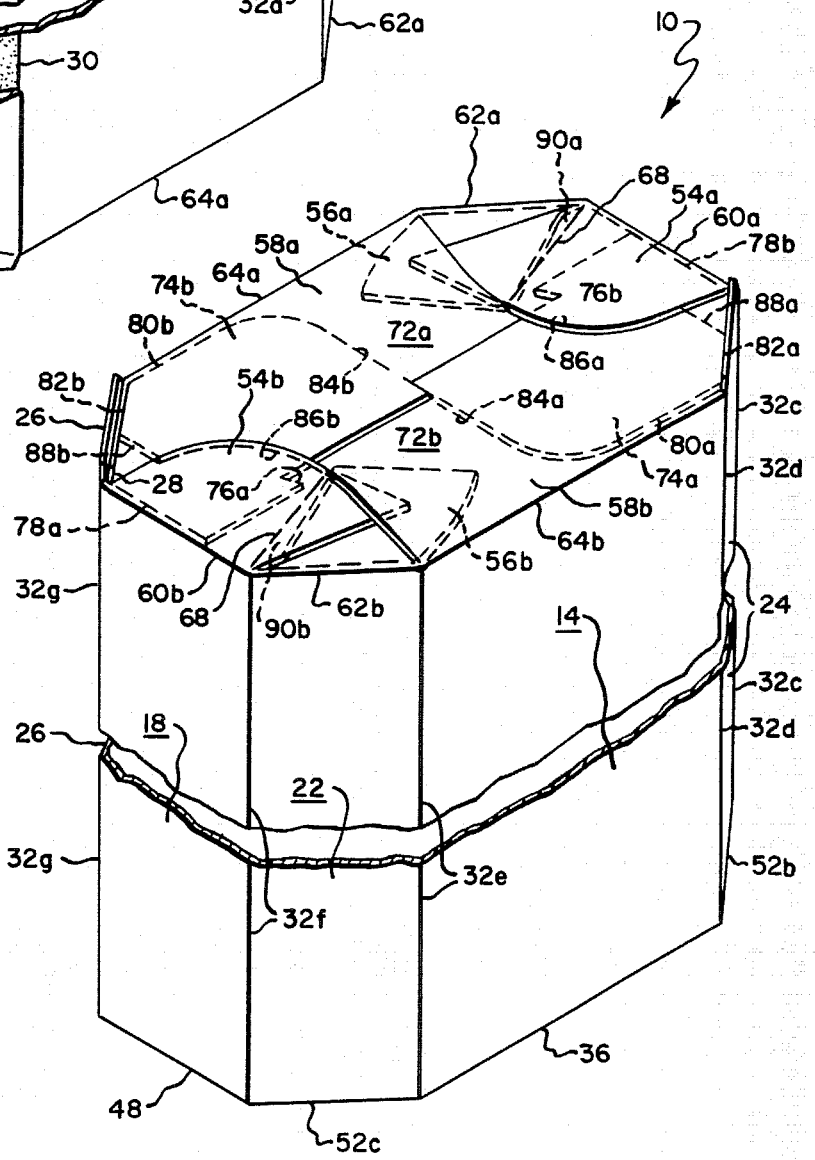
FIG. 6 is a view similar to FIG. 5, this view being taken from the bottom left rear.

Referring first to FIG. 5, the container of this invention, which is indicated generally at 10, is shown in the position which it will occupy once having received its contents. Thus, the top and bottom will normally be in the position shown in FIG. 5 as it will be necessary for the bottom to support the contents of the container, which bottom has been designed for this purpose. In addition, the container of this invention will have eight sides, and side number 12 has been designated as the front panel. As can be appreciated from this figure, the sides of the container are formed from four pairs of opposed rectangular side panels, and one pair is of greater width than the other. Thus, the pair of panels which includes front panel 12 and rear panel 14 (FIG. 1) is of greater width than the other side panels which include a pair of side panels, and two pairs of corner panels. The side panels include right and left side panels 16,18, respectively. One pair of corner panels includes the right front corner panel 20 and left rear corner panel 22. The other set of corner panels includes the rear right corner 24 and the front left corner panel 26. In addition to these various side panels, the container also includes a glue flap 28 which is hingedly secured to one side panel, specifically the front side panel 12, and which, after erection, is glued to the surface of another side panel, specifically the left front corner panel 26. It can be seen that the glue flap is hingedly secured to the panel 12 along a vertically extending fold line 30 and that each of the other panels is hingedly secured to adjacent side panels along parallel fold lines which are indicated at 32*a*–32*g*. The inside of the container is shown in FIG. 1, and in this regard it should be noted that the outside surface (the back surface) of glue flap 28 receives the glue, which glue is then adhered to the inside of the left front corner flap 26 during the gluing process. The glue is indicated by the stippling in FIG. 5.

The top of the container in the embodiment illustrated is formed from an octagonal top panel 34 which is hingedly secured to the top edge of the back panel 14 along fold line 36. Opposite the fold line 36 is another fold line 38 to which a tab 40 is hingedly secured, which tab is of approximately the same width dimension as the front panel 12. Two other tabs 42 and 44 are hingedly secured to the top panel 34 along fold lines 46 and 48, these tabs having a width dimension corresponding generally to that of the side panels 16 and 18. The three small spaced-apart tabs 40,42,44 are recevied between four small spaced-apart top panels 50*a*–50*d*, which are hingedly secured to top edges of alternate side panels, and specifically the corner side panels, along fold lines 52*a*–52*d*. It can be seen from FIG. 5 that the various tabs and top panels cooperate with each other to assure that the octagonal top panel 34 will be disposed in its proper position when the container is fully erected and the top is closed.

The bottom of the container shown in the drawings is preferably formed from two sets of three adjacent panels. When the container is erected, it can be seen that these various bottom flaps form three opposed pairs, the first pair of bottom flaps being indicated at 54*a*,54*b*, the second pair of bottom flaps being indicated at 56*a*,56*b*, and the third pair of bottom flaps being indicated at 58*a*,58*b*. Each of these bottom flaps are provided with a straight edge which is hingedly secured to the bottom straight edge of an associated side panel along various fold lines. Thus, the bottom flaps 54*a*,54*b* are hingedly secured to the right and left side panels 16,18, respectively along fold lines 60*a*,60*b*, respectively. Similarly, the second pair of bottom flaps 56*a*,56*b* are secured to corner panels 20,22 along fold lines 62*a*,62*b*. Finally, the third pair of bottom flaps are secured to the front and rear panels 12 and 14 along fold lines 64*a* and 64*b*.

Each of the first pair of bottom flaps 54*a* and 54*b* includes first and second generally triangular portions, the second triangular portion receiving glue which is indicated by the stippling 66 in FIG. 1. This triangular portion is separated from the first generally triangular portion along a fold line 68 which is scored to permit a 180° fold. It can be seen that the second generally triangular portion of each of the bottom flaps will act as a glue flap and during machine assembly the glue flap 66 will be glued to the outside or bottom surface of the adjacent flap 56.

As can best be seen from FIG. 1 each of the second pair of bottom flaps 56 is in the shape of a rhomboid, the edge on the short side of the rhomboid being hingedly secured to the adjacent side panel 20 or 22, along the fold line 62.

Each bottom flap of the third pair of bottom flaps 58 can be considered to have two portions which lie on opposite sides of construction line 70 (FIG. 1). Thus, each of the third pair of bottom flaps, which are substantially larger than the first and second pair of bottom flaps, has first and second portions, the first portions being indicated at 72*a* and 72*b*, and the second portions being indicated at 74*a* and 74*b*. The first portion is hingedly secured to the adjacent panel along fold line 64. Opposite the fold line, and to one side of the adjacent panel center line (indicated by construction line 12*a* or 14*a*), the first portion is provided with an edge having a notch indicated either at 76*a* or 76*b*. Adjacent the notched edge, the first portion of the bottom panel is provided with two adjacent straight edges 77 and 78. The second portion 74 is also provided with various edges, and that edge remote from the first portion is indicated at 80. Another edge is indicated at 82. Another straight edge is closely adjacent the center line 12*a* or 14*a*. This edge 84 merges into the edge 80 along a radiused corner. There is also a curved edge 86 which merges into the first portion 72. The curved edge 86 has a portion which extends away from the first portion 72 and which terminates in another edge 88 which intersects edge 82. It should be emphasized that the second portion of each of the third pair of bottom flaps is disposed entirely to one side of the center line of the side panel to which the first portion is secured. This is so that the second portions 74*a* and 74*b* may overlie a part of each of the first portions 72*b*,72*a*, respectively, when the container is in its fully erected position.

Figure 2:
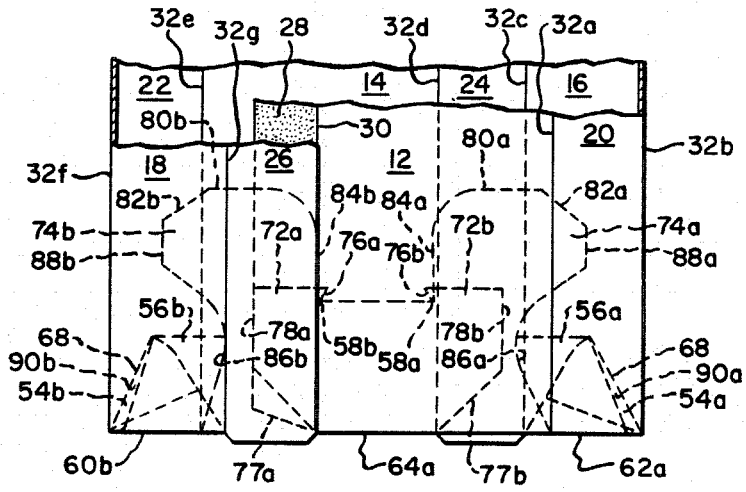
FIG. 2 is a view of the bottom portion of the blank shown in FIG. 1 after various parts have been glued to each other, the container being shown folded flap for shipping.
Figure 3:
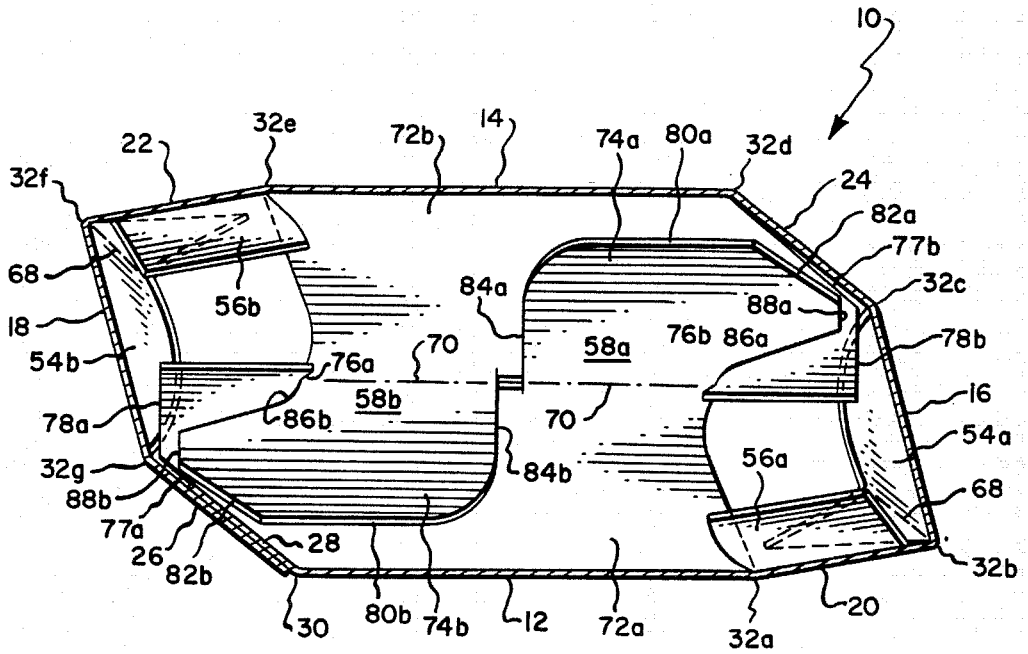
FIG. 3 is a sectional view of the container looking down at the bottom when the bottom has been partially opened, various flaps of the bottom interlocking with each other to maintain the container in its partially opened condition.
Figure 4:
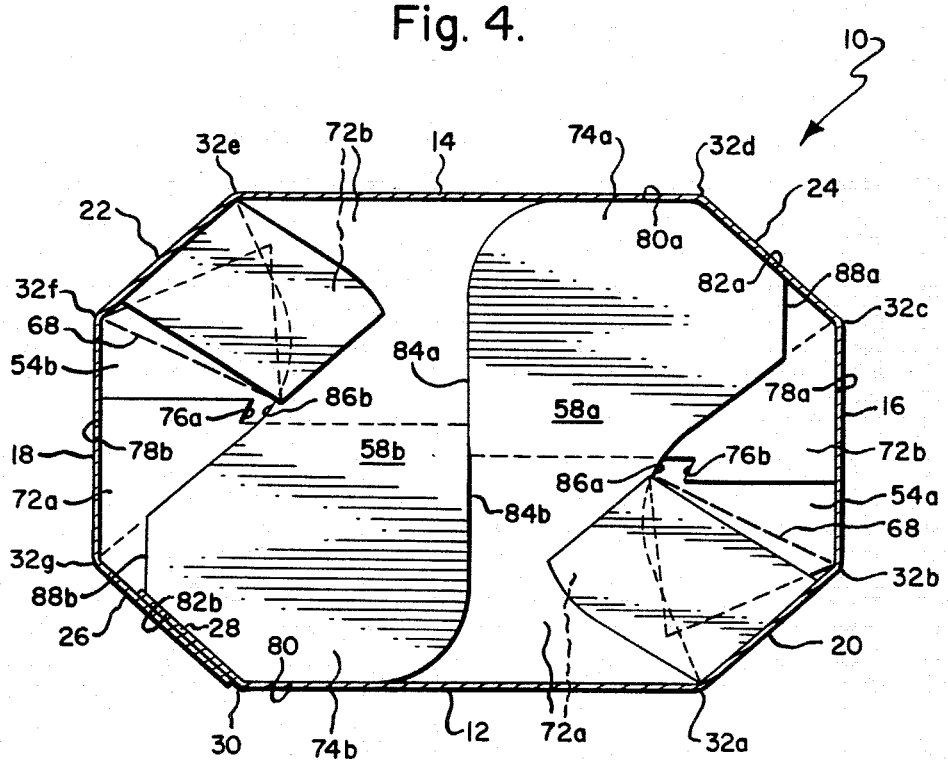
FIG. 4 is a view somewhat similar to FIG. 3 but showing the bottom in its fully opened position.

After the blank has been die cut to the shape indicated in FIG. 1, and after glue has been applied to the various glue flaps 28 and 54, the parts are glued together. To this end, the outer surface of glue flap 28 will be secured to the inner surface of corner flap 26, and each of the glue flaps 66 will be secured to the bottom or outer surface of the adjacent flap 56. After the parts have been so glued, the bottom is folded within the container in the manner indicated in FIG. 2 for shipment from the container manufacturing plant to another location where the container will be filled. Once the container is ready to be filled, the container can be partially opened manually at which point the notches 76 will engage the curved surfaces 86 to hold the container and maintain it in a partially erected position. At this point, the container can be fully erected merely by inserting the contents into the container, which contents can be for example a liquor bottle, which will cause the bottom to become fully set to the position indicated in FIG. 4. When the bottom is fully set it can be seen that a relatively strong bottom is provided as the various parts will overlie and interlock with each other to form a bottom of superior strength. Thus, the second portion 74 of each of the third pair of bottom flaps will overlie another portion 72 of the opposite bottom flap. Thus, the second portion 74*a* of the bottom flap 54*a* will overlie at least part of the first portion 72*b* of the bottom flap 58*b* with the edge 82*a* adjacent the inner surface of the right rear corner 24 and with the edge 80*a* lying along the inner surface of the back panel 14 to the right side of the center line 14*a* along the fold line 64*b*. Part of the first portion 72*b* (i.e., to the right of 74*a* in FIG. 4) will in turn overlie part of the first triangular portion of the bottom flap 54*a* with edges 77*b* and 78*b* being disposed closely adjacent side panels 24 and 16, edge 78*b* also being disposed closely adjacent the fold line 60*a*. The second triangular portion of the panel 54*a* will be covered by the flap 54*a*, which flap also overlies part of the first portion 72*a* of the bottom flap 58*a*. In like manner, the opposite parts from those just described will have the same relationship. In order to prevent undue binding of the various parts when erected, it is desirable to place a notch between adjacent first and second bottom flaps 54 and 56 to prevent warping of the board.

While a preferred structure in which the principles of the present invention have been incorporated is shown and described above, it is to be understood that this invention is not to be limited to the particular details shown and described above, but that, in fact, widely differing means may be employed in the practice of the broader aspects of this invention.

What is claimed is:

1. An eight-sided container comprising:

a main body which, when fully erected is of tubular form, the main body including four pairs of opposed rectangular side panels and a side glue flap which is hingedly connected to one side panel and glued to the surface of another side panel, each of the other side panels being hingedly secured to adjacent panels; and a bottom formed of six die cut bottom flaps associated with six of the side panels, the bottom flaps including a first pair of opposed bottom flaps, each including first and second generally triangular portions, one edge of the first triangular portion being hingedly secured to one edge of an associated side panel, and the second triangular portion having one edge hingedly secured to another edge of the first triangular portion, said second triangular portion acting as a bottom glue flap, a second pair of opposed bottom flaps, each including one edge hingedly secured to one end of an associated side panel, the second pair of bottom flaps being disposed adjacent the first pair of opposed bottom flaps with each of the second triangular portions of the first pair being glued to a surface of an adjacent one of the second pair of opposed bottom flaps, and a third pair of opposed bottom flaps which are substantially larger than the first and second pairs, each one of the third pair of flaps including first and second portions, one side edge of the first portion being hingedly secured to the bottom edge of an associated side panel of a first pair of opposed side panels, and the second portion extending away from the first portion and being disposed to one side of a longitudinally extending center line of the side panel to which the first portion is secured, the second portion additionally overlying a part of the first portion of the other one of the third pair of flaps.

2. The eight-sided container as set forth in claim 1 wherein each side panel of said first pair of opposed side panels is of greater width than the side panels of the other pairs.

3. The eight-sided container as set forth in claim 1 wherein the second portion of each of the third pair of opposed bottom flaps has an edge disposed closely adjacent the side panel opposite its associated side panel.

4. The eight-sided container as set forth in claim 3 wherein the second portion of each of the third pair of opposed bottom flaps has a second edge disposed closely adjacent another side panel.

5. The eight-sided container as set forth in claim 1 wherein each side panel of said first pair of opposed side panels is of greater width than the side panels of the other pairs, and wherein the second portion of each of the third pair of bottom flaps has adjacent first and second edges, the first edge being disposed closely adjacent the side panel opposite its associated side panel, and the other edge being disposed closely adjacent another side panel.

6. The eight-sided container as set forth in claim 1 wherein each of the second pair of opposed bottom flaps is in the shape of a rhomboid.

7. The eight-sided container as set forth in claim 6 wherein said one edge of each of the second pair of bottom flaps is on the shorter side of said rhomboid.

8. The eight-sided container as set forth in claim 1 wherein a portion of each one of the second pair of opposed bottom flaps overlies part of the first portion of each of the third pair of opposed bottom flaps.

9. The eight-sided container as set forth in claim 1 wherein a second edge of the first portion of each of the third pair of bottom flaps is provided with a notch capable of engaging a side edge of the opposed bottom flap.

10. The eight-sided container as set forth in claim 1 wherein said side edge is curved.

11. The eight-sided container as set forth in claim 1 wherein a part of the first portion of each of the third pair of opposed bottom flaps overlies a part of an associated one of the first pair of opposed bottom flaps.

12. The eight-sided container as set forth in claim 11 wherein a portion of each of the second pair of opposed bottom flaps overlies part of the first portion of one of the third pair of opposed bottom flaps.

13. The eight-sided container as set forth in claim 12 wherein the second portion of each of the third pair of bottom flaps has edge portions disposed closely adjacent an opposite side panel and another side panel adjacent the opposite side panel.

14. The eight-sided container as set forth in claim 1 further comprising a top formed of a large octagonal top panel having one edge hingedly secured to the upper edge of an associated side panel, three small spaced apart tabs hingedly secured to the edges of the top panel, and further characterized by the provision of four small spaced apart top panels which are hingedly secured to top edges of side panels, the tabs being received between the small top panels.

15. The eight-sided container as set forth in claim 1 wherein the side glue flap is connected to one of the first pair of opposed side panels.

16. The eight-sided container as set forth in claim 1 wherein the adjacent flaps of the first and second pairs of opposed bottom flaps are slightly spaced away from each other.

* * * * *